US008743539B2

(12) United States Patent
Zhang

(10) Patent No.: US 8,743,539 B2
(45) Date of Patent: Jun. 3, 2014

(54) ACCESSORY SECURING MECHANISM

(75) Inventor: Yu Zhang, Shenzhen (CN)

(73) Assignees: Shenzhen Futaihong Precision Industry Co., Ltd., Shenzhen (CN); FIH (Hong Kong) Limited, Kowloon (HK)

( * ) Notice: Subject to any disclaimer, the term of this patent is extended or adjusted under 35 U.S.C. 154(b) by 1315 days.

(21) Appl. No.: 12/549,168

(22) Filed: Aug. 27, 2009

(65) Prior Publication Data

US 2010/0102576 A1 Apr. 29, 2010

(30) Foreign Application Priority Data

Oct. 23, 2008 (CN) ..... 2008 1 0305096

(51) Int. Cl.
*G06F 1/16* (2006.01)

(52) U.S. Cl.
USPC ..... 361/679.56; 361/679.03; 361/679.59; 292/17; 292/76

(58) Field of Classification Search
USPC ..... 292/80, 81, 83, 87, 88, 90, 14, 16, 17, 292/19, 70, 71, 74, 76, 252, 261, 299, 300, 292/302, 303, DIG. 10, DIG. 11, DIG. 16, 292/DIG. 50; 361/679.03, 679.56, 679.59; 248/686, 690, 691, 693; 24/3.12, 457, 24/458; 379/441, 445, 447; 16/110.1, 406, 16/422, 425, 428; 396/423; 206/320; 220/752, 754, 759, 766; 224/220, 254, 224/255, 257, 930
See application file for complete search history.

(56) References Cited

U.S. PATENT DOCUMENTS

| | | | | | |
|---|---|---|---|---|---|
| 429,246 | A * | 6/1890 | Pfingsten | 292/76 |
| 610,374 | A * | 9/1898 | Young | 24/676 |
| 923,738 | A * | 6/1909 | Walker | 24/45 |
| 1,349,569 | A * | 8/1920 | Hart | 24/676 |
| 1,596,773 | A * | 8/1926 | Spotz | 220/326 |
| 4,058,242 | A * | 11/1977 | Brewer | 224/606 |
| 6,182,169 | B1 * | 1/2001 | Force et al. | 710/62 |
| 6,536,621 | B2 * | 3/2003 | Yokobori | 220/4.02 |
| 7,929,297 | B2 * | 4/2011 | Chen | 361/679.56 |
| 8,014,133 | B2 * | 9/2011 | Dong et al. | 361/679.01 |
| 8,068,332 | B2 * | 11/2011 | Yang et al. | 361/679.01 |
| 8,194,405 | B2 * | 6/2012 | Dong | 361/679.01 |
| 8,199,492 | B2 * | 6/2012 | Liang et al. | 361/679.56 |
| 8,223,480 | B2 * | 7/2012 | Dong | 361/679.03 |
| 8,224,404 | B2 * | 7/2012 | Yang et al. | 455/575.1 |
| 8,300,388 | B2 * | 10/2012 | Li | 361/679.01 |
| 8,448,998 | B2 * | 5/2013 | Lu | 292/163 |
| 2006/0138182 | A1 * | 6/2006 | Carlsson | 224/257 |
| 2010/0092234 | A1 * | 4/2010 | Zhang et al. | 403/23 |

FOREIGN PATENT DOCUMENTS

JP 08321864 A * 12/1996

* cited by examiner

*Primary Examiner* — Carlos Lugo
*Assistant Examiner* — Alyson M Merlino
(74) *Attorney, Agent, or Firm* — Novak Druce Connolly Bove + Quigg LLP

(57) ABSTRACT

A accessory securing mechanism includes a housing member, a cover member, and an engaging member. The housing member defines a cutout and forms a pole unit protruding from the bottom of the cutout. The engaging member includes an elastic washer, the washer is sleeved into the pole unit.

7 Claims, 4 Drawing Sheets

ACCESSORY SECURING MECHANISM

BACKGROUND

1. Technical Field

The present disclosure relates to an accessory securing mechanism for a portable electronic device.

2. Description of Related Art

With development of wireless communication technology, portable electronic devices such as mobile phones are widely used. A typical accessory securing mechanism has a through aperture defined in a housing member of the portable electronic device. The through aperture has two connecting opening ends at the housing member, and accordingly forms a hanging wall therebetween. To assemble an accessory such as a handle strap to the portable electronic device, the handle strap is usually passed through one opening end and extends out from the other opening end. The handle strap can be twisted to hang on the hang wall. However, the hanging wall may fail when the handle strap is pulled with a large force, thus, the housing member is broken and hardly to repair it.

Therefore, there is room for improvement within the art.

BRIEF DESCRIPTION OF THE DRAWING

Many aspects of the present accessory securing mechanism in electronic device can be better understood with reference to the following drawings. The components in the various drawings are not necessarily drawn to scale, the emphasis instead being placed upon clearly illustrating the principles of the present accessory securing mechanism in electronic device. Moreover, in the drawings, like reference numerals designate corresponding parts throughout the diagrams.

DETAILED DESCRIPTION OF THE EMBODIMENT

Figure 1:
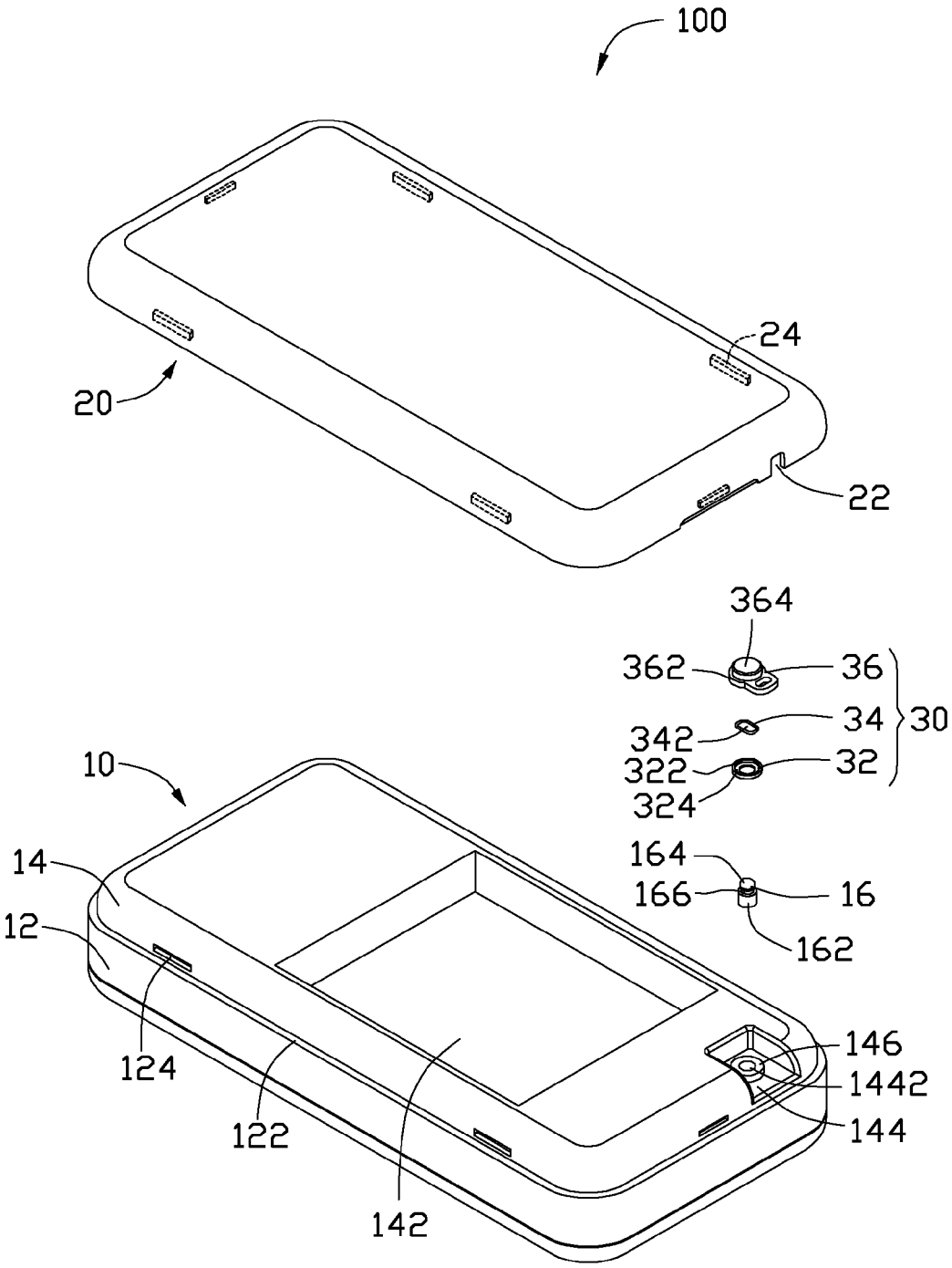
FIG. 1 is an exploded, isometric view of an accessory securing mechanism according to an exemplary embodiment.

Referring to FIG. 1, an exemplary accessory securing mechanism 100, which can be used in mobile phones and other portable electronic devices, includes a housing member 10, a cover 20, and an engaging member 30.

The housing member 10 includes a top portion 12, a bottom portion 14, and a pole unit 16. A ledge 122 encircles the top portion 12, adjacent to the bottom portion 14. The bottom portion 14 is configured for engaging with the cover 20 and defines a receiving cavity 142 in the middle, a cutout 144 at a side and through the ledge 122. The receiving cavity 142 is used to receive a battery. A circular support 146 protrudes from the bottom wall of the cutout 144. The circular support 146 defines a pivot hole 1442. The pole unit 16 is used to engage into the pivot hole 1442. The pole unit 16 includes spherical head 164 and a cylindrical body 162. A diameter of the body 162 is substantially the same as that of the pivot hole 1442. Thus, the body 162 is fittingly insertable into the pivot hole 1442. A circular depression 166 is defined around the body 162 and adjacent to the head 164. The depression 166 is engageable with the engaging member 30. A plurality of latching protrusions 124 are disposed around the periphery of the bottom portion 14. The latching protrusions 124 are used to secure the cover 20.

The cover member 20 defines a notch 22 in side of the cover member 20 corresponding the cutout 144. The notch 22 and the cutout 144 can cooperatively receive a strap handle (not shown). The cover member 20 defines a plurality of latching slots 24 engageable with the locks 124.

The engaging member 30 includes a cap 32, a rectangular elastic washer 34 and a receiving seat 36. The cap 32 defines a circular receiving chamber 322 for receiving the washer 34. The cap 32 further defines a pivot aperture 324 communicating with the receiving chamber 322. The pivot aperture 324 has substantially the same diameter as the head 164. The washer 34 can be received in the receiving chamber 322 and used to hold the pole unit 16, the washer 34 has a rectangle space 342 for receiving of the pole unit 16, the width of the space 342 is less than the diameter of the body 162 of the pole unit 16.

Figure 2:
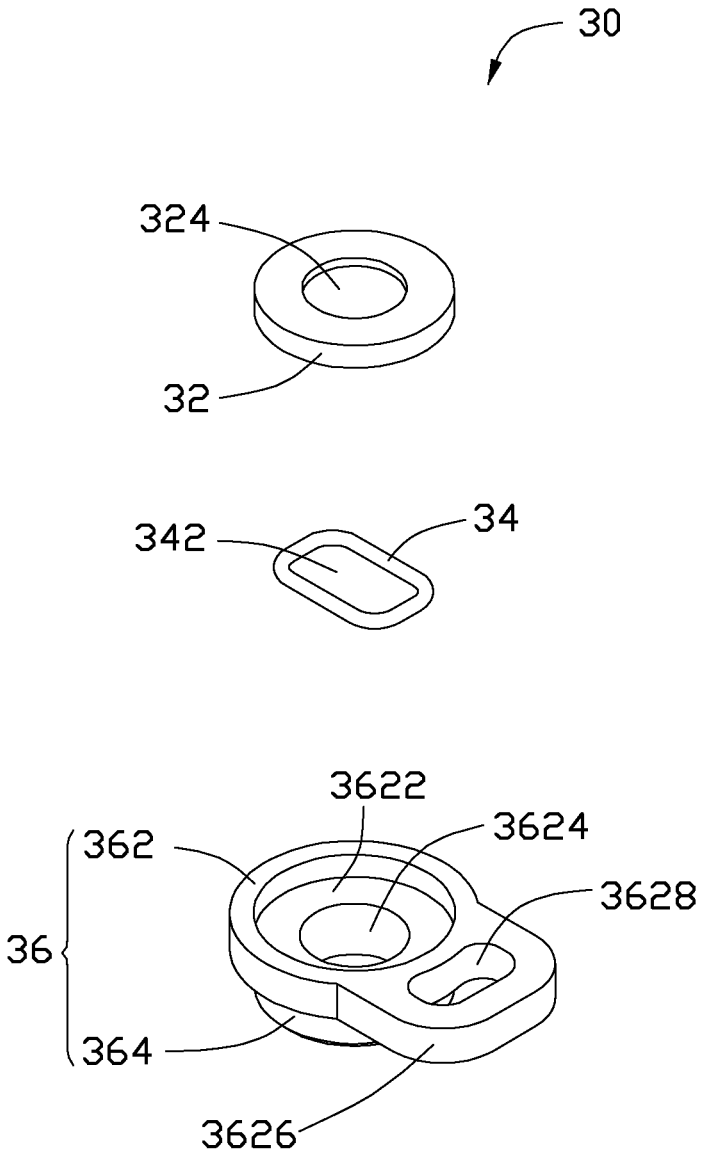
FIG. 2 is an exploded, isometric view of an engaging member of the accessory securing mechanism shown in FIG. 1.

Referring further to FIG. 2, the receiving seat 36 includes a main portion 362 and a protruding portion 364 protruding from the main portion 362. The main portion 362 defines a circular recess 3622, a size of the recess 3622 corresponds to the cap 32 for engagingly receiving the cap 32. The bottom of the recess 3622 defines an engaging cavity 3624 extending toward the protruding portion 364. The engaging cavity 3624 has substantially the same diameter as the head 164 for engagingly receiving the head 164. The main portion 362 has an extending portion 3626 extending laterally on the periphery wall thereof, the extending portion 3626 defines a through connecting hole 3628 for hanging a handle strap.

Figure 3:
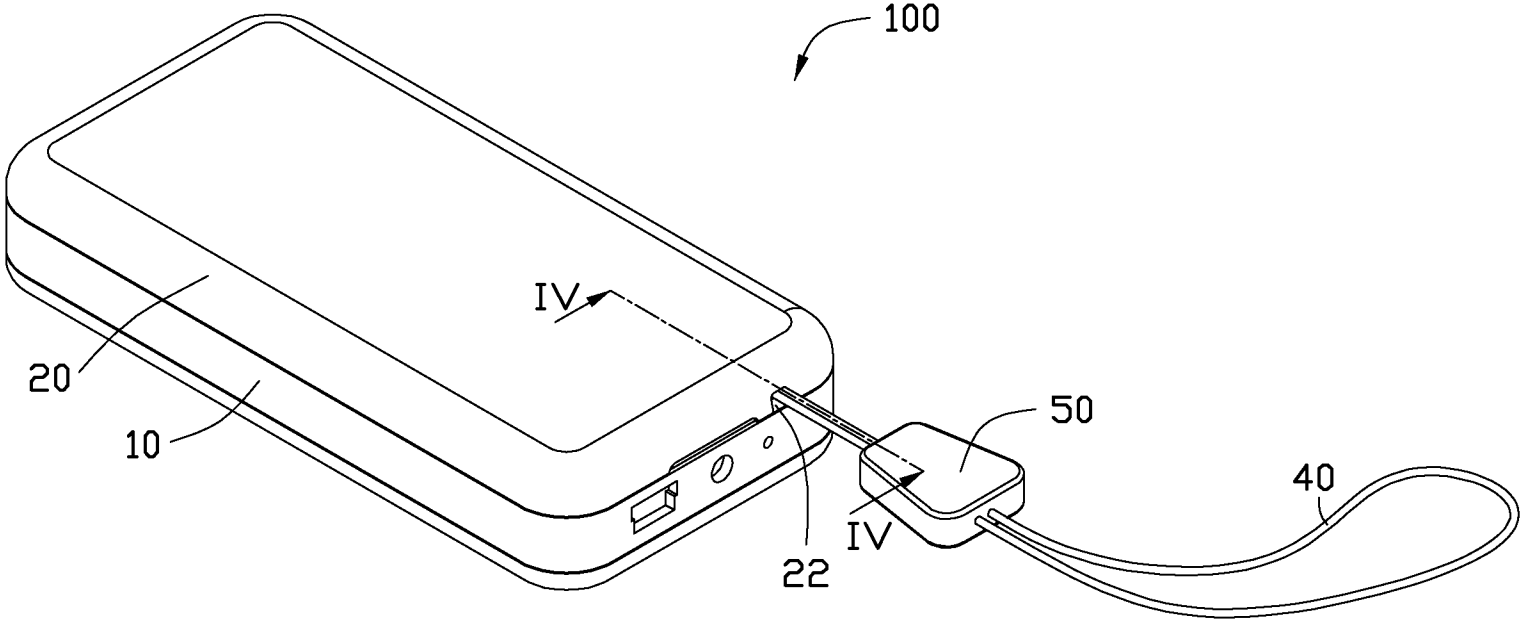
FIG. 3 is an assembled, isometric view of the accessory securing mechanism shown in FIG. 1.
Figure 4:
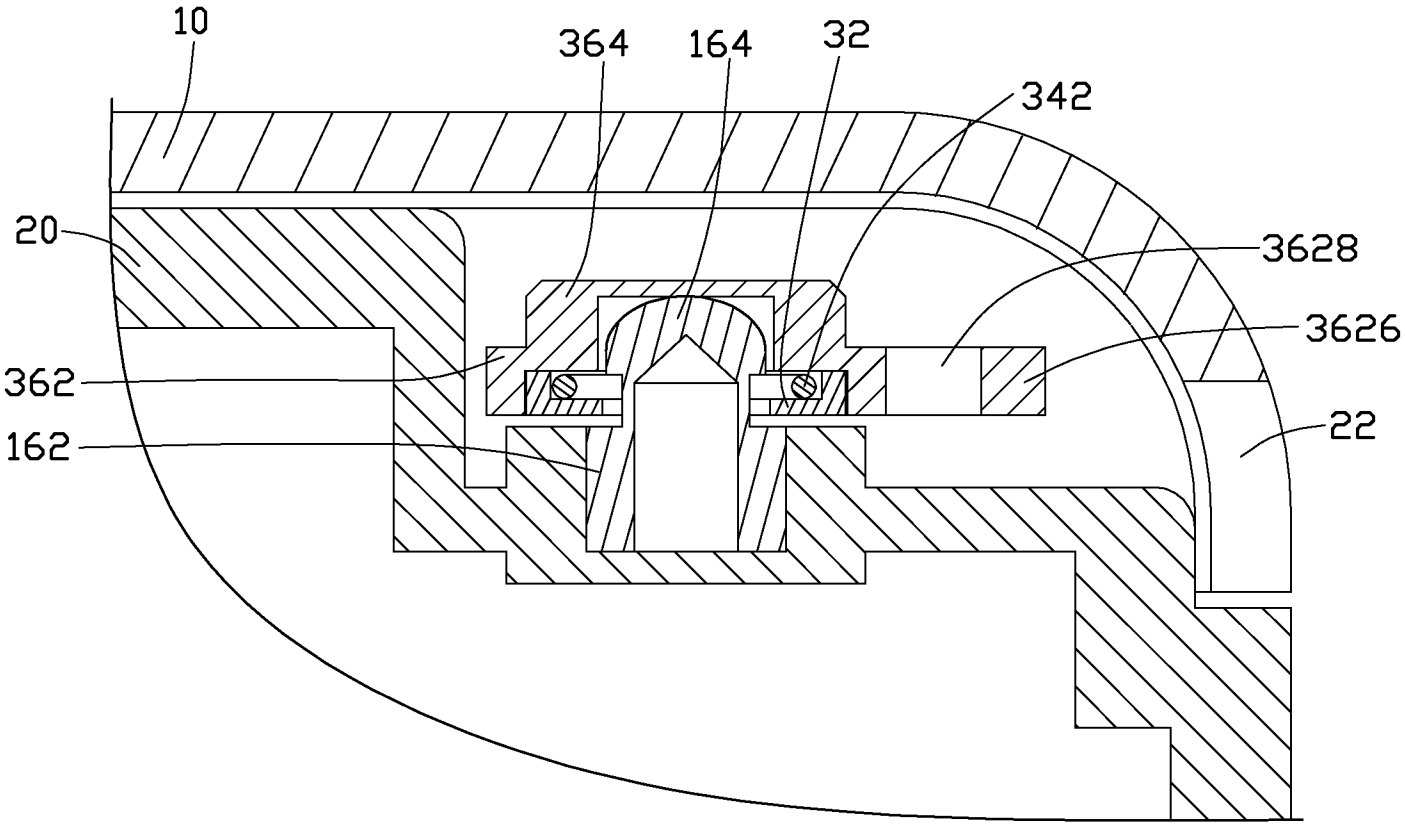
FIG. 4 is an assembled, section view along the III-III line of FIG. 3.

Referring to FIGS. 3 and 4, a looped handle strap 40 is provided with a slider 50 slidably tied/sleeved around it. To assemble the accessory securing mechanism 100, the washer 34 is positioned in the receiving chamber 322 in a way such that the corner points of the washer 34 abut the inner cylindrical surface of the receiving chamber 322. The cap 32 is secured in the receiving seat 36. At this stage, the cap 32 is received in the recess 3622 and the washer 34 abuts the bottom surface of the recess 3622. The cap 32, the washer 34 and the receiving seat 36 are assembled integrally, the engaging hole 324, the space 342 and the receiving cavity 3624 are aligned with all. The pole unit 16 is fixed to the housing 10, the body 162 is inserted into the pivot hole 1442 of the cutout 144. The depression 166 and the head 164 are located out of the pivot hole 1442 and exposed in the cutout 144.

To hang the handle strap 40 in the accessory securing mechanism 100, the handle strap 40 may be affixed to the engaging member 30. During this stage, the handle strap 40 passes through the connecting hole 3628, then twisted and hung by a side portion of the connecting hole 3628. The engaging member 30 is mounted to the housing member 10. Due to the washer 34 is elastic, the head 164 can passes through the pivot aperture 324 of the cap 32, the space 342 of the washer 34 and enters into the engaging cavity 3624 of the receiving seat 36. At the same time, the difference in size between the space 342 of the washer 34 and body 162, the washer 34 can be received into the depression 166 and securely clip the body 162. The cover member 20 is locked to the housing member 10 by engaging the locks 124 into the locking cavities 24 of the cover member 20. The handle strap 40 is pulled through the notch 22 of the cover member 20 to the outside.

It is to be understood that the pole unit 16 can be integrally formed with the housing member 10. The cap 32 and the receiving seat 36 can be omitted, accordingly, the handle strap 40 may be directly hung by the washer 34.

It is to be understood that even though numerous characteristics and advantages of the present embodiments have been set forth in the foregoing description, together with details of structures and functions of various embodiments, the disclosure is illustrative only, and changes may be made in detail, especially in matters of shape, size, and arrangement of parts within the principles of the present invention to the full extent indicated by the broad general meaning of the terms in which the appended claims are expressed.

What is claimed is:

1. An accessory securing mechanism, comprising: a housing member having a pole unit; a cover member for covering the housing member; and an engaging member; wherein the engaging member includes a receiving seat, a cap, and an elastic washer and wherein the washer is sleeved with the pole unit, wherein the cap defines a receiving chamber to receive the washer, the cap is secured in the receiving seat, and the bottom of the receiving chamber defines a through pivot aperture, wherein the pole unit passes through the pivot aperture; wherein the housing member defines a cutout, the pole unit protrudes from a bottom surface of the cutout, the pole unit defines a circular depression and wherein the washer is received and latched into the circular depression, the pole unit includes a spherical head and a cylindrical body and wherein the circular depression is defined around the cylindrical body and adjacent to the spherical head, wherein the receiving seat defines a recess, and wherein the cap is placed into the recess to secure the cap in the receiving seat and the washer abuts a bottom surface of the recess.

2. The accessory securing mechanism as claimed in claim 1, wherein a pivot hole is defined in the bottom surface of the cutout, the cylindrical body of the pole unit is assembled in the pivot hole such that the circular depression and the spherical head are exposed.

3. The accessory securing mechanism as claimed in claim 1, wherein the washer has a space, and wherein an engaging cavity is defined at the bottom surface of the recess such that the head of the pole unit can pass through the pivot aperture and the space, and enter into the engaging cavity.

4. The accessory securing mechanism as claimed in claim 1, wherein the receiving seat includes a main portion, the main portion includes an extending portion extending laterally, wherein the extending portion defines a connecting hole for hanging a handle strap.

5. The accessory securing mechanism as claimed in claim 1, wherein the cover member defines a notch corresponding to the cutout of the housing member.

6. An accessory securing mechanism, comprising:

a housing member defining a cutout;

a pole unit fixed to the cutout in the housing;

a cover member for covering the housing member;

an engaging member; and a handle strap;

wherein the engaging member includes a receiving seat, a cap, and an elastic washer, and the pole unit defines a depression, wherein the elastic washer is sleeved into the depression, the handle strap is affixed to the receiving seat, wherein the cap defines a receiving chamber to receive the elastic washer and the bottom of the receiving chamber defines a through pivot aperture, wherein the receiving seat defines a recess to receive the cap, the cover member covers the housing member such that an end of the handle strap extends out the cutout.

7. The accessory securing mechanism as claimed in claim 6, wherein the pole unit includes a spherical head, wherein the washer has a space and a bottom surface of the recess defines an engaging cavity such that the spherical head can pass through the pivot aperture and the space, and enter into the engaging cavity.

* * * * *